United States Patent [19]

Koenuma et al.

[11] 4,048,725

[45] Sept. 20, 1977

[54] FEED INDEX DEVICE IN UNIVERSAL PARALLEL RULER OR THE LIKE

[75] Inventors: Masao Koenuma; Yoshitaka Gibu, both of Tokyo, Japan

[73] Assignee: Asahi Seimitsu Kabu Shiki Kaisha, Oizumi, Japan

[21] Appl. No.: 655,599

[22] Filed: Feb. 5, 1976

[51] Int. Cl.[2] ..... B43L 13/24

[52] U.S. Cl. ..... 33/81

[58] Field of Search ..... 33/81, 40, 110

[56] References Cited

U.S. PATENT DOCUMENTS

| | | | |
|---|---|---|---|
| 534,099 | 2/1895 | English | 33/81 X |
| 2,106,070 | 1/1938 | Spitz | 33/81 |
| 3,025,604 | 3/1962 | Shelly | 33/81 |
| 3,077,668 | 2/1963 | Carter | 33/81 |
| 3,762,055 | 10/1973 | Citrin | 33/81 |
| 3,925,900 | 12/1975 | Raffensparger | 33/81 |

*Primary Examiner*—Charles E. Phillips

*Attorney, Agent, or Firm*—Griffin, Branigan and Butler

[57] ABSTRACT

A feed indexing device for a draftsman's straight-edge includes a control member that can be selectively linked to a straight-edge carriage plate. When the control member is linked to the carriage plate, it is rotated proportionately to carriage plate movement. An indexing mechanism is included for allowing the control member to only rotate a preset distance for each resetting thereof. A brake mechanism is included for braking further movements of the carriage plate during resetting of the control member.

11 Claims, 14 Drawing Figures

Fig - 4
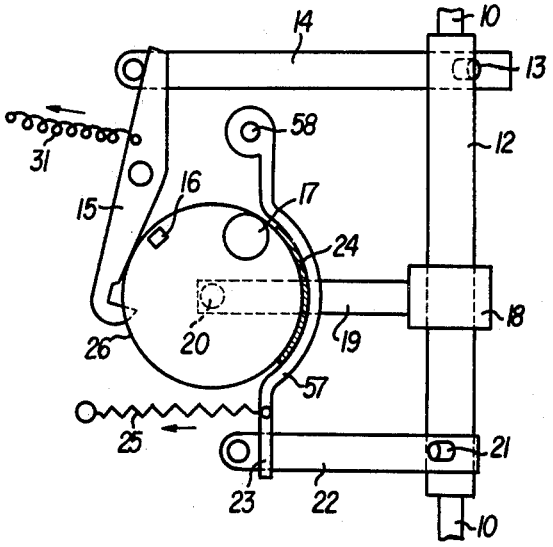
Fig - 5A
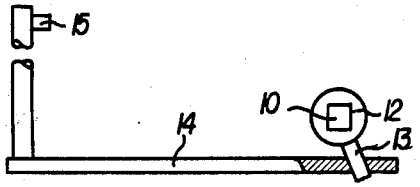
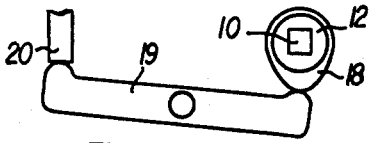
Fig - 5B
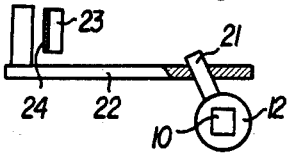
Fig - 5C

FEED INDEX DEVICE IN UNIVERSAL PARALLEL RULER OR THE LIKE

BACKGROUND OF THE INVENTION

The present invention relates to a feed index device in a universal parallel ruler or the like to a draw a plurality of lines at desired intervals with high accuracy.

In drawing a hatching which represent a section, dimension lines, ruled lines on slip or note, display of tiles in a building drawing etc., it is substantially more preferable with respect to accuracy and convenience to regulate an interval at which the scale of a universal parallel ruler is parallelly moved according to a desired set value than to move the scale according to eye-measurement or with use of a separate ruler for every line.

There have already been proposed devices for this purpose. For example, there is one in which a guide track is provided with a rack and a movable straightedge carriage plate adapted to move along the rack. There is a pinion adapted to be engaged with said movable carriage plate so that a rotation of the pinion is multiplied and transmitted by a gear train to a rotatable index plate or table. Thus a movement distance of the movable carriage plate may be visually determined according to a rotating angle set on the index plate or table. In another prior-art system a plurality of ratchet wheels of different pitches are coaxially mounted on a shaft which is rotated as a movable carriage plate moves and there are provided selectably engageable stoppers respectively in association with said ratchet wheels so that the movement of the movable carriage plate may be regulated by operation of the stoppers. The first of these prior-art systems is disadvantageous in that the movement distance of the movable carriage plate can be determined according to the rotating angle of the index table but it is impossible for the movable carriage plate to be automatically stopped for each predetermined movement distance thereof. The second system is also disadvantageous in that unpractically many ratchet wheels are required to regulate the movement distance of the movable plate according to a desired value and a mechanism for operation of the stoppers must be complicated, since the movement distance of the movable carriage plate is defined by the pitch intervals of the ratchet wheels.

It is the principal object of the present invention to provide, in view of the disadvantages of the prior art as mentioned above, a feed index device in a universal parallel ruler or the like, which is simplified in structure and easy to handle selectively adjustable so that movement distance of a movable carriage plate (i.e., the movement distance of the straightedge) may be optionally selected; and automatic so that the movable plate is automatically stopped for every movement distance thus selected.

SUMMARY

According to the principles of the present invention the movement interval distance of the movable carriage plate along a guide track is regulated by a cam member including a cam surface adapted to be adjustable in accordance with every setting of an index plate or table. Thus, the shape of the cam member may be utilized to the maximum for accurate and efficient control of movement of the movable plate. More specifically, the movement of the movable carriage plate (or straight edge) is transmitted by a suitable clutch mechanism to a control member as corresponding rotary movement. The amount of this rotary movement of the control member is regulated to a value which corresponds to the movement distance set by the cam member and thereby the movement distance of the movable carriage plate is accurately determined. The movable carriage plate is successively moved in steps of this predetermined distance and thereby enables one to draw a plurality of lines of equal intervals on the straightedge. The control member reciprocally rotates according to the amount set with cam member between an initial position and an end position, allowing the movable plate to move as said control member rotates in one direction while rotating in the other direction to the initial position when the movable plate is stationary. Accordingly, the linkage for transmitting movement of the movable carriage plate to the control member as rotary movement thereof includes, in addition to said clutch mechanism enabling the control member to return to the initial position when this is desired, a brake adapted to keep the movable plate at the stationary position. Furthermore, it is necessary to bias the control member, under the effect of a restoring spring to the initial position.

BRIEF DESCRIPTION OF THE DRAWINGS

FIG. 4 is a simplified plan view showing another important part of the device;

FIG. 5A, 5B, and 5C are side, partially sectionalized views showing portions of the important part of FIG. 4 as dismantled;

DESCRIPTION OF PREFERRED EMBODIMENT

Figure 1:
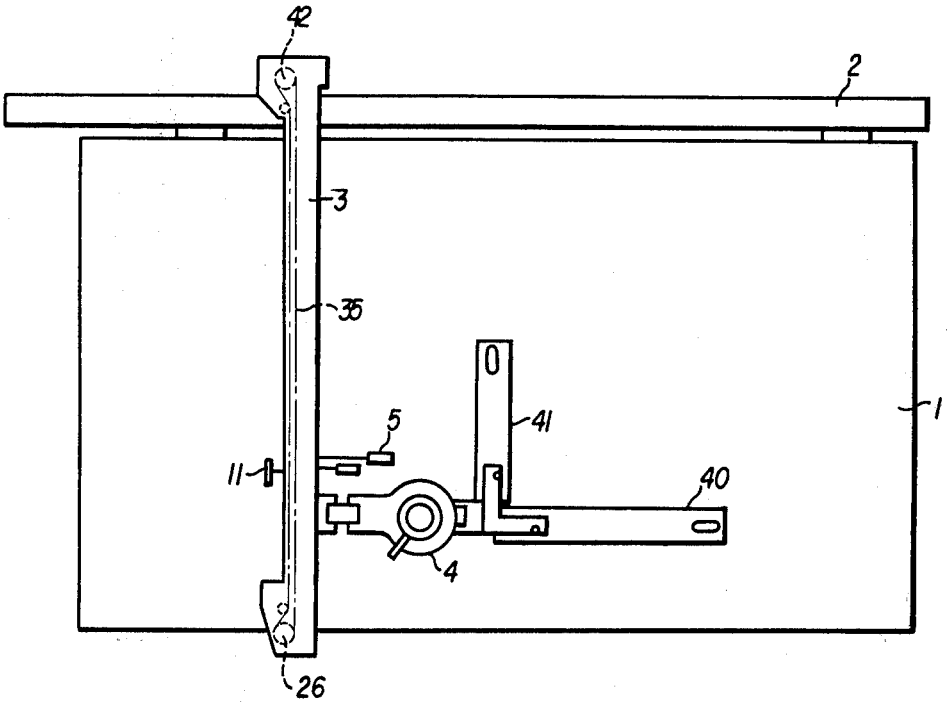
FIG. 1 is a top view of a simplified drawing apparatus employing principles of this invention.

The present invention will be now described more in detail with reference to a preferred embodiment shown by the accompanying drawings. Referring to FIG. 1 which illustrates the manner in which the device according to the present invention is used reference numeral 1 designates a drawing board, reference numeral 2 designates a lateral guide track, reference numeral 3 designates a vertical guide track and reference numeral 4 designates a head to support scales or straightedges 40 and 41. The head 4 is moved along the vertical guide track 3 by a linkage with a movable carriage plate 6. Accordingly, the device according to the present invention may be provided not only between the vertical guide track 3 and the movable plate 6 but also between the lateral guide track 2 and the vertical guide track 3.

Figure 2:
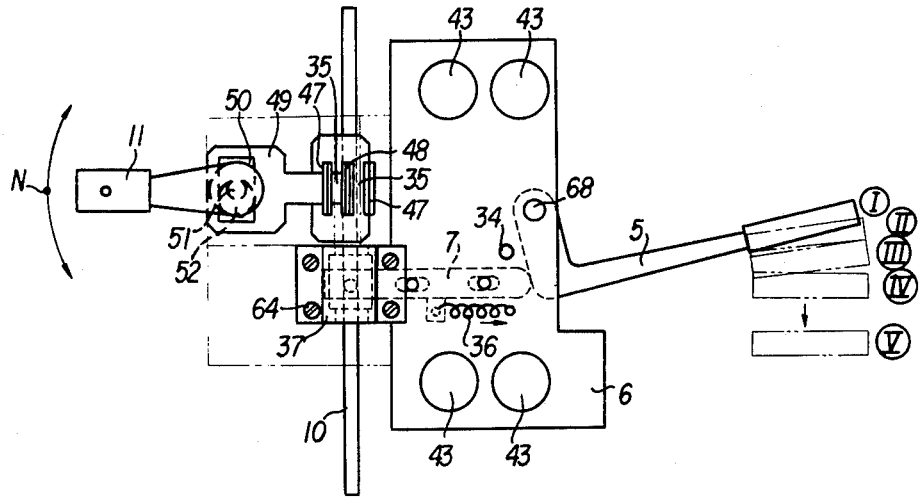
FIG. 2 is a plan view showing an important part of the device of this invention.
Figure 3:
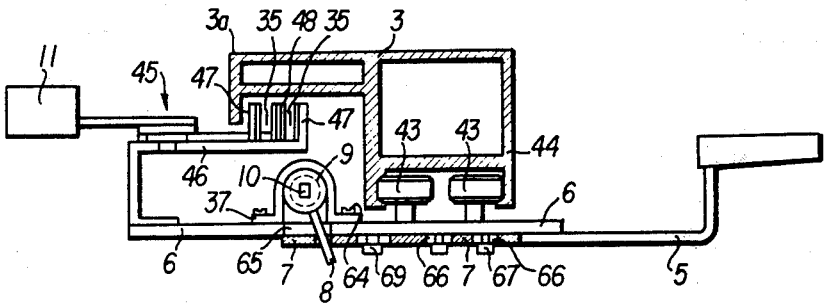
FIG. 3 is a side view showing the important part shown by FIG. 2 in a section and further including a guide track.

Referring to the preferred embodiment as shown, a relationship between the vertical guide track 3 and the movable carriage plate 6 will be now described. The guide track 3 is provided at upper and lower ends with rotatable pulleys 42 and 26 around which a belt 35 extends. There are provided auxiliary pulleys (not shown) by which the belt may be smoothly guided. It will be obviously understood that various means such as wire, chain and timing belt may be used as this belt 35. The movable carriage plate 6 has rollers 43 projecting upwardly, as seen in FIGS. 2 and 3, so as to be engaged with guide rails 44 of the vertical guide track 3 and moves along the guide track 3. Both sides of said belt 35 extend parallel to each other within a lateral frame 3*a* of the vertical guide track 3 and move in opposite directions, respectively. The movable carriage plate 6 includes in unison a nipper device 45 to selectively nip one or the other side of the belt 35. The nipper device 45 comprises a pair of stationary nipper pieces 47 between which both sides of the belt 35 are located and a movable nipper piece 48 located between these both sides of the belt 35 and adapted to be movable between the pair of stationary nipper pieces 47. Friction pieces of high frictional coefficient are respectively mounted on nipper surfaces of the nipper pieces 47 and 48. The movable nipper piece 48 is carried by the front end of a follower 49 which is, in turn, movable on a support frame 46 in a lateral direction, as shown in FIGS. 2 and 3, and the follower 49 is provided at its rear end with a cam slot 50. A cam rotating shaft 51 adapted to be rotated integrally with a nipper operating lever 11 is mounted in the cam slot 10 substantially at the center and an eccentric cam 52 is fixed on the cam rotating shaft 51 at such a position that said eccentric cam 52 fits into said cam slot 50. Either side of the belt 35 may be held by nipping effect between the nipper pieces 47 and 48 as the nipper operating lever 11 is rotated from the neutral position in one of opposite directions indicated by a double arrow in FIG. 2. When the movable plate 6 is moved along the guide track 3 with the belt 35 being nipped, accordingly, the nipped belt 35 is simultaneously circulated and the pulley 26 is also rotated.

Figure 7:
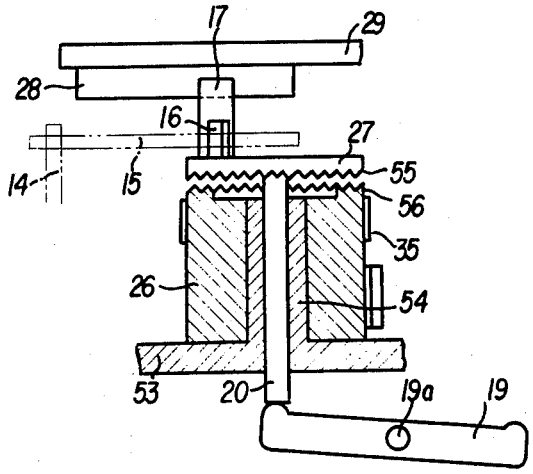
FIG. 7 is a side view showing the part shown by FIG. 6 partially in a section.
Figure 9:
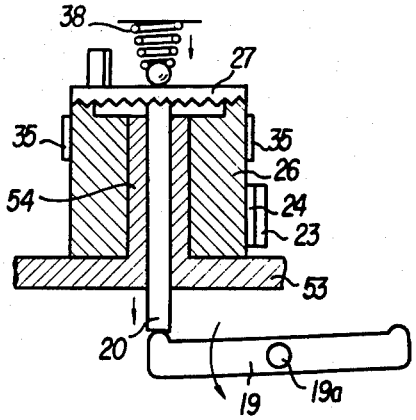

It is seen from FIGS. 7 and 9 that the pulley 26 is rotatably supported around a hollow stationary shaft 54 fixed to a stationary plate 53 of the guide track 3 and is rotated as the belt 35 extending therearound travels. In the embodiment as shown, a disc-like control member 27 is provided above the pulley 26 so that the disc-like control member 27 may be rotated on a rotatable shaft 20, to which the control member 27 is fixed and which is loosely inserted into said hollow stationary shaft 54. The control member 27 may be vertically moved together with said rotatable shaft 20. Said rotatable shaft 20 extends downwardly through the stationary plate 53. The control member 27 has on the underside a clutch toothed surface 55 and the pulley 26 has on the upper side a corresponding clutch toothed surface 56 adapted to be engaged with the clutch toothed surface 55. Also the control member 27 has centrally on the upper side thereof a presser spring 38 serving to maintain these toothed surfaces together, thus constituting a clutch mechanism engaged with each other. The rotatable shaft 20 is provided at its lower end with a lever 19 operatively associated with the clutch mechanism to release the clutch mechanism against the resilience of said presser spring 38. Reference numeral 19*a* designates a shaft supported by a stationary portion of the guide track 3 so that the lever 19 operatively associated with the clutch mechanism may be pivotally supported on this shaft 19*a.* Although the pulley 26 is operatively associated through the clutch toothed surfaces 55 and 56 with the control member 27 in serial manner in the embodiment as above described, it is obviously possible that both elements could be disposed on separate axes and operatively associated by each other with interposition of well known means, such as a gear train or a reversible clutch mechanism. It should be noted here that the various elements, such as the belt 35, the nipper device 45, the pulley 26, and the clutch mechanism 55, 56 together form linkage means for transmission of movement between the movable plate 6 and the control member 27.

A brake device 57 is arranged in lateral opposition to the pulley 26 to brake the pulley as the brake device comes into contact therewith. This brake device 57 is carried at one end by a rotatable shaft 58 mounted on the stationary portion of the guide track 3 and has at the other end a brake spring 25 serving to urge a friction plate 24 against the pulley 26. The brake device includes, a brake plate 23 carrying thereon the friction plate 24 and a brake lever 22 adjacent to an end of the brake plate 23. The brake lever is used to operate the brake plate 23 against the brake spring 25 so that the friction plate 24 may be disengaged from the pulley 26. Obviously, it is also possible to replace the friction plate 24 by a member having a notch adapted to be engaged with an irregular surface of the pulley 26. It is possible for a brake member to have teeth adapted to be engaged with corresponding teeth on the pulley 26.

The control member 27 has on its upper surface, adjacent to the periphery, a stop pin 16 in the form of a square column and a pin 17 suitably spaced from said stop pin 16 so as to come into contact with an adjustable means such as the cam member 28. The stop 16 may be engaged by the stopper member 15 to regulate the end position of rotation of the control member 27 and the pin 17 may be engaged by the cam member 28 to regulate the initial position of the control member 27. The control member 27 is provided with a restoring spring 32 which biases the pin 17 to rotate normally against the cam member 28.

Although the control member 27 is in the form of a disc having on the underside a clutch toothed surface 55 in the embodiment as shown, it is principally sufficient that the control member 27 is rotated with the rotatable shaft 20 so that the initial and end positions thereof may be regulated by the cam member 28 and the stopper member 15, respectively. Accordingly, the pin 17 and the stop pin 16 are not required to be separately provided as in the described embodiment. The arrangement according to the embodiment is, however, advantageous in that there is provided a sufficient space for the elements such as the cam member 28, the stopper member 15 and the restoring spring 32.

In the described embodiment, the stopper member 15 centrally includes a rotatable shaft 59 which is, in turn, supported by a stationary portion of the guide track 3, in the front end 15*a* a groove 60 adapted to be engaged with the stop pin 16 to lock the latter and on the other end a tension spring 31 serving to bias the stopper member 15 so that said groove 60 is normally located to be engaged with the stop pin 16. The stopper member 15 is furthermore provided on the other end with the stopper operating lever 14 serving to retract the groove 60 against the effect of the tension spring 31 and thereby to disengage this groove from the stop pin 16.

The cam member 28 rotates around a cam shaft 61 together with an index plate or table 29 mounted coaxially and integrally therewith and displaces the pin 17 according to the position indexed by a graduation 62 of the index plate or table 29 for successive regulation of the initial position of the control member 27. In the described embodiment, the index table 29 has along the outer periphery click grooves 63 formed at equal intervals into which a clock ball 30, suitably spring biased, is engaged to regulate the indexing position of the index table 29. It would also be possible, however, to have a index carried on a stationary portion of track 3 and brought into coincidence with the indexing graduation on the index table 29 to set a desired index value (i.e., the movement distance), wherein the index table 29 could be fixed in a well known manner by use of fixing means utilized in such prior art devices as the universal parallel ruler.

The manner in which the index device as mentioned above is operated will be now described. Referring to FIGS. 2 and 3, reference numeral 10 designate a link rod having a square cross-section arranged along and in parallel to the guide track 3. The link rod 10 is rotatably supported at opposite ends on upper and lower stationary portions of the vertical guide truck 3, respectively. Reference numeral 37 designates a guide ring supporting member in inverted U-shape which is secured by screws 64 to the upper surface of the movable plate 6. A guide ring 9 is rotatably supported by said supporting member 37 and the link rod 10 loosely extends through the guide ring 9 along its axis. Thus, the guide ring 9 longitudinally moves with respect to the link rod 10 as the movable plate 6 moves and rotates integrally with said link rod 10. The guide ring 9 has integral therewith a feed linkage pin 8 projecting downward through a slot 65 formed in the movable plate 6 and a rotation range of the guide ring 9 is defined by a width of the slot 65.

The movable carriage plate 6 is provided on its lower surface with a linkage plate 7 adapted to be moved in the rotating direction of the feed linkage pin 8. Reference numeral 66 designates a slot formed in the linkage plate 7 and a support screw 67 is secured to the movable plate with a leg portion of the support screw extending through the slot 66. Between the linkage plate 7 and the movable plate 6 there is provided a strong restoring spring 36 adapted to bias the linkage plate 7 rightward as seen in FIG. 3. The feed linkage pin 8 is engaged with the left end of the linkage plate 7 so that the feed linkage pin 8, the guide ring 9 and the linkage rod 10 may be integrally rotated as the linkage plate 7 moves.

Reference numeral 5 designates an operating lever in L-shape which is rotatably supported at one end by a pivot 68 on the underside of the movable plate 6 with an angular portion thereof bearing against the right end of the linkage plate 7. Reference numeral 34 designates a stopper for said operating lever 5, which is planted on the underside of the movable plate 6.

Accordingly, the linkage rod 10 is rotated clockwise as seen in FIG. 3 as the operating lever 5 is rotated clockwise as seen in FIG. 2. A cam shaft 12 is secured to the linkage rod 10 adjacent to the lower end as shown by FIGS. 4 and 5. The stopper operating pin 13, the clutch operating cam 18 and the brake operating pin 21 are integrally mounted on the cam shaft 12 so that these members may be associated in proper timing with the stopper operating lever 14, the clutch linkage lever 19 and the brake lever 22, respectively.

Figure 12:
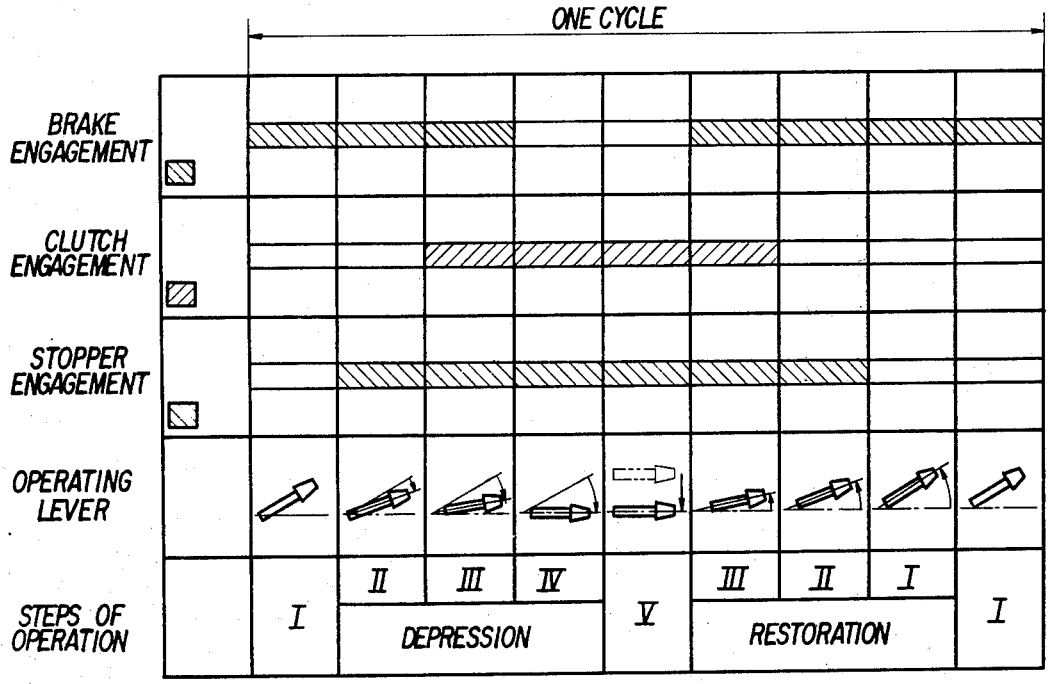
FIG. 12 is a diagrammatic chart illustrating the manner in which a device according to the present invention operates.

Referring to FIGS. 2 through 12, the stopper operating pin 13, as the operating lever 5 is slightly rotated from a fixed position I to a second position II, activates the stopper operating lever 14 and thereby drives the stopper member 15 to the position at which the stopper member is engaged with the stop pin 16. The clutch operating cam 18, as the operating lever 5 is further rotated to a third position III, activates the clutch linkage lever 19 to cause engagement of the clutch mechanism 55, 56. And finally the brake operating pin 21, as the operating lever 5 is further rotated to a fourth position IV, activates the brake lever 22 to cancel a braking effect. It should be noted here that FIG. 12 illustrates the manners in which the brake device, the clutch mechanism and the stopper member respectively operate during one cycle of operation of the operating lever 5, wherein hatched areas represent the state in which the respective members are engaged or engageable and blank areas represent the state in which the respective members are disengaged. The numerals I, II . . . designating the steps of operation are given in accordance with the rotary positions of the operating lever 5 in FIG. 2.

The manner in which the device described above operates is now described. The device may be handled in the same manner as the drawing set of ordinary type when the belt nipper lever 11 is set to the neutral position N. However it enables a plurality of equal interval lines to be effectively drawn when the lever 11 is rotated in one of the directions indicated by the double arrow in FIG. 2 so that the belt 35 is thereby connected with the movable plate 6. With the arrangement such that the control member 27 rotates counterclockwise from the initial position to the end position as in the embodiment, when it is desired to move the movable plate 6 from the top of the guide track 3 downward, the lever 11 may be clockwise rotated and the left side of the belt 35 may be nipped between the nipper pieces 47, 48 as seen in FIG. 2. With the operating lever 5 being at the fixed position I, the brake plate 23 of the brake device is pressed against the pulley 26 as seen in FIG. 12 to restrain the movable plate 6 against its movement, permitting the first line to be drawn. The clutch mechanism 55, 56 and the stopper member 15 are in disengaged state with the lever 5 being at the fixed position I, so that a desired movement distance may be set by the index table 29 to rotate the control member 27 by the pin over the preset angular distance under a driving effect of the cam member 28 and thereby to regulate the initial position of the control member 27.

Figure 6:
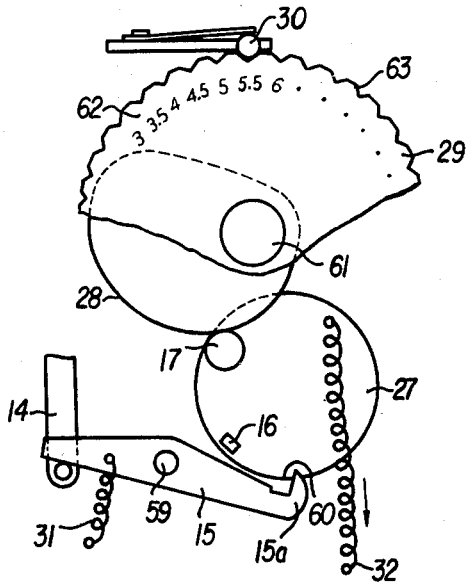
FIG. 6 is a plan view showing yet another important part of the device as partially broken away.
Figure 8:
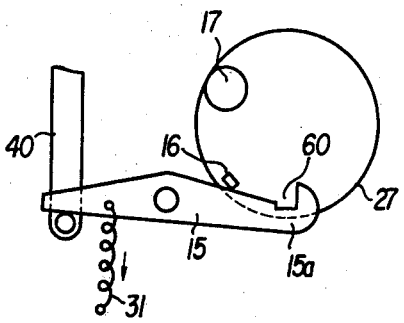
FIGS. 8 to 10 are simplified views depicting isolated mechanisms to illustrate the manner in which the device according to the present inventon operates.
Figure 10:
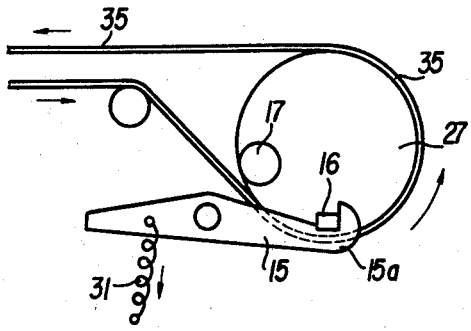
Figure 11:
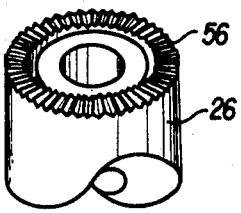
FIG. 11 is a perspective view illustrating a portion of an important member.

It is assumed here that the operating lever 5 is clockwise rotated from the fixed position I. When the operating lever 5 reaches the second position II, as seen in FIG. 12, the stopper member 15 is brought to the position at which the member 15 may be engaged with the pin 16 and, when the operating lever 5 is further rotated to the third position III, the clutch mechanism 55, 56 is brought into its state of engagement. This engagement is brought about as described above by an operating means made up of, in the illustrated embodiment, the lever 5, the linkage plate 7, the linkage rod 10, the operating cam 18, the clutch linkage lever 19, and the rotatable shaft 20. When the operating lever 5 further reaches the fourth position IV, the brake plate 23 of the brake device release the pulley 26. Accordingly, the operating lever 5 may be continuously urged (Obviously it is also possible that a force is simultaneously applied to the head in the direction of movement) in order to rotate the control member 27 together with the pulley 26. These two members then move from the state as shown by FIG. 6 through the intermediate state as shown by FIG. 8, to the end position as shown by FIG. 10 in which the stopper member 15 comes into engagement with the stop pin 16. Finally the movable plate 6 is stopped when the operating lever 5 reaches the fifth position V. The distance over which the movable plate 6 has moved corresponds to the value which was set by the index table 29. When the operating lever 5 is disengaged, the operating lever 5 returns together with the linkage rod 10 and the cam shaft 12 to the fixed position I under the effect of the strong restoring spring 36 mounted on the linkage plate 7. However, the pulley 26 is subjected to the effect of the brake device upon said disengagement of the operating lever 5 and then the clutch mechanism 55, 56 is brought out of the engaged state. This time lag assures that the pulley 26 is prevented from reverse rotation when the control member 27 returns under the effect of the restoring spring 32 to the initial position and the movable plate 6 remains stationary at the predetermined position. Thus, repeated operation of said operating lever 5 enables a plurality of equal interval lines to be drawn efficiently and accurately.

It will be apparent from the aforegoing description that, with the device according to the present invention, the movement of the movable plate relative to the guide track is transmitted by linkage including the clutch mechanism to the control member 27. Rotary movement thereof is allowed from the initial position to the end position and the initial position or the end position is regulated by the cam member adapted to come in contact with the control member 27. The device according to the present invention is thus advantageous not only in that the movement distance of the movable plate may be accurately and easily set as described but also in that the device is easy to handle and simplified in structure.

What is claimed is:

1. A straightedge movement control mechanism for use in a universal parallel ruler or the like to provide incremental movement of a straightedge over a drawing surface, said mechanism comprising:

a track means for guiding a straightedge;

a movable carriage plate including said straight-edge, said carriage plate being mounted on, and movable along, said track means;

a control member mounted on said track means for reciprocal motion between an initial position and an end position;

a linkage means coupled between said movable carriage plate and said control member for transmitting movement of said movable carriage plate along said track to said control member to thereby move said control member from said initial position to said end position, said linkage means including a clutch mechanism for disengaging said linkage means to allow said control member to move independently of said movable carriage plate back to said initial position;

a stop member mounted on said track means located at one of said initial and end positions to stop the movement of said control member thereat;

an adjustable means located at the other of said initial and end positions to stop the movement of said control member thereat; and, operating means linked to said movable carriage plate for allowing movement of said movable carriage plate and linked to said clutch mechanism for engaging said clutch mechanism when said operating means is activated to move said carriage plate and said coupled control member from said initial position to said end position, but disengaging said clutch mechanism when said operating means is deactivated.

2. A control mechanism as in claim 1 and further including a braking means linked to said operating means for braking movement of said movable carriage plate when said clutch mechanism is disengaged.

3. A control mechanism as in claim 2 wherein said stop member is movable between an inactive position in which it comes into contact with said control member when said control member is moved to the end position and an inactive position in which the stop member would not contact said control mechanism if said control member were moved to the end position.

4. A control mechanism as in claim 3 and further including a stop linkage means connected between said operating means and said stop member for moving the stop member into said active position when said operating means is actuated to move said movable plate.

5. A control mechanism as in claim 4 and further including a restoring spring for biasing said control member to rotate back to said initial position upon disengagement of said clutch mechanism.

6. A control mechanism as in claim 1 and further including a restoring spring for biasing said control member to rotate back to said initial position upon disengagement of said clutch mechanism.

7. A control mechanism as in claim 2 wherein said stop member is movable between an inactive position in which it comes into contact with said control member when said control member is moved to the end position and an inactive position in which it would not contact said control member if said control member are moved to the end position.

8. A control mechanism as in claim 1 wherein said adjustable means is a rotatable cam.

9. A straightedge movement control mechanism for use in a universal parallel ruler or the like to provide incremental movement of a straightedge over a drawing surface, said mechanism comprising:

a track means for guiding a straightedge;

a movable carriage plate including said straightedge, said carriage plate being mounted on, and movable along, said track means;

a control member mounted on said track means for rotatable reciprocal motion between an initial position and an end position;

a linkage means coupled between said movable carriage plate and said control member for transmitting movement of said movable carriage plate along said track to said control member to thereby rotate said control member from said initial position, to said end position, said linkage means including a belt to which said movable carriage plate is attached and which rides on and drives a pulley linked to said control member, said linkage means further including a clutch mechanism between said pulley and said control member for disengaging to allow said control member to move independently of said movable carriage plate back to said initial position;

a stop member mounted on said track means located at one of said initial and end positions to stop the movement of said control member thereat;

an adjustable means located at the other of said initial and end positions to stop the movement of said control member thereat; and, operating means linked to said movable carriage plate for moving said movable carriage plate and linked to said clutch mechanism for engaging said clutch mechanism when said operating means is activated to move said movable carriage plate and said coupled control member from said initial position to said end position, but disengaging said clutch mechanism when said operating means is deactivated.

10. A straightedge movement control mechanism as in claim 9 wherein said operating means includes a rotatable rod and an activating lever mounted on said movable carriage plate for rotating said rotatable rod when pressure is applied to said activating lever to move said movable carriage plate, said movable carriage plate being slidably mounted on said rod, said operating means further including a clutch linkage on said track means for disengaging said clutch mechanism in response to rotation of said rotatable rod.

11. A straightedge movement control mechanism as in claim 10 wherein is further included a braking means for braking rotation of said pulley when said clutch mechanism is disengaged, and wherein is further included a brake linkage on said track means for disengaging said braking means in response to rotation of said rod.

* * * * *